United States Patent [19]

Collura et al.

[11] 4,216,897

[45] Aug. 12, 1980

[54] LOCK FOR A CORNER LOCK CARTON

[75] Inventors: Peter C. Collura, Los Altos; Richard L. Humphries, Sunnyvale, both of Calif.

[73] Assignee: Kliklok Corporation, Greenwich, Conn.

[21] Appl. No.: 28,177

[22] Filed: Apr. 9, 1979

[51] Int. Cl.[2] ..... B65D 5/26

[52] U.S. Cl. ..... 229/35; 229/32

[58] Field of Search ..... 229/35, 32; 206/627

[56] References Cited

U.S. PATENT DOCUMENTS

| | | | |
|---|---|---|---|
| 2,580,181 | 12/1951 | Meller | 229/35 |
| 2,634,899 | 4/1953 | Meller | 229/35 |
| 2,712,409 | 7/1955 | Buttery | 229/35 |
| 3,037,680 | 6/1962 | Hickin | 229/35 |
| 3,053,429 | 9/1962 | Pierce, Jr. | 229/32 |
| 3,069,061 | 12/1962 | Dion | 229/35 |
| 3,226,006 | 12/1965 | Dunn | 229/35 |
| 3,310,220 | 3/1967 | Feldman | 206/626 X |

*Primary Examiner*—Davis T. Moorhead

*Attorney, Agent, or Firm*—Lowe, King, Price & Becker

[57] ABSTRACT

A corner lock carton exhibiting improved lock retention includes a base panel, a pair of wall panels, and a locking flap panel joined to one of the wall panels. The other wall panel includes a locking slit formed inwardly thereon to receive the locking flap panel. The slit has a vertical segment, a horizontal segment, and an angled segment connecting the vertical and horizontal segments the ends of the angled segments being disposed at an angle of 40° to the vertical segment. The flap panel includes a lock member having a first edge portion aligned parallel to the vertical segment of the slit when the carton is erected and a second edge portion disposed at an angle of 45° to the first edge portion. When the wall panels are erected, the lock member is disposed through the slit, and the second edge portion of lock member engages the slit at a point adjacent the juncture of the vertical segment and the angled segment to securely interlock the flap panel and slit together. The angled slit segment and the angled edge of the lock member have an angular separation of at least five degrees when interlocked. [Since the point of interlocking engagement is adjacent the base of the lock member and the intersection of the vertical and angled segments, when pressure is applied to the side panels, the point of interlocking engagement does not shift. In one embodiment, the angled segment is formed having an arcuate shape to provide a "double-locking" retention feature.]

8 Claims, 11 Drawing Figures

Fig. 2
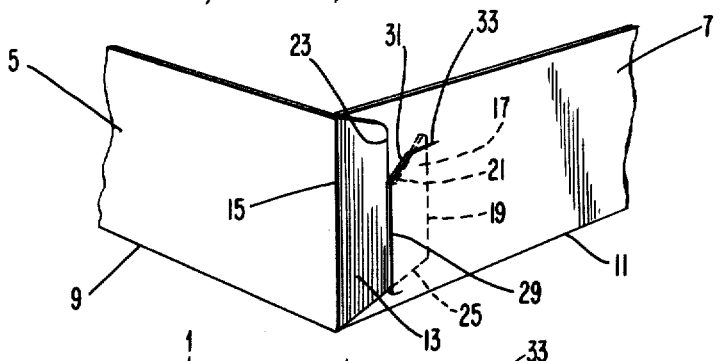
Fig. 1
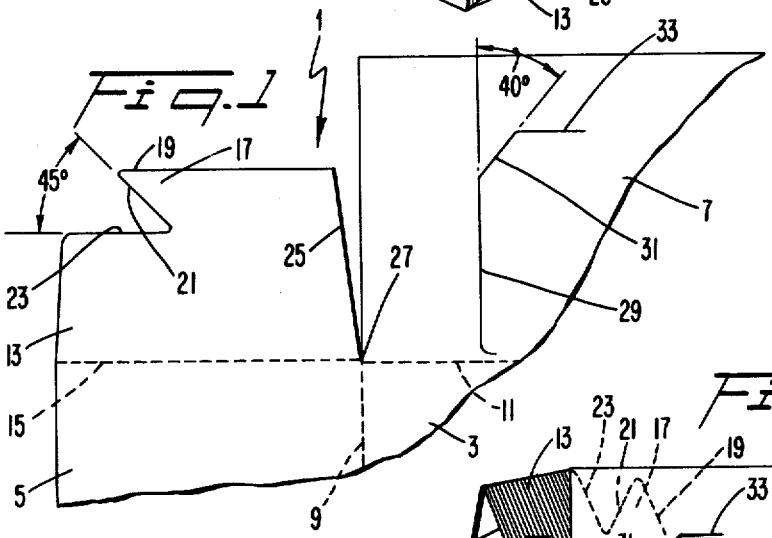
Fig. 3A
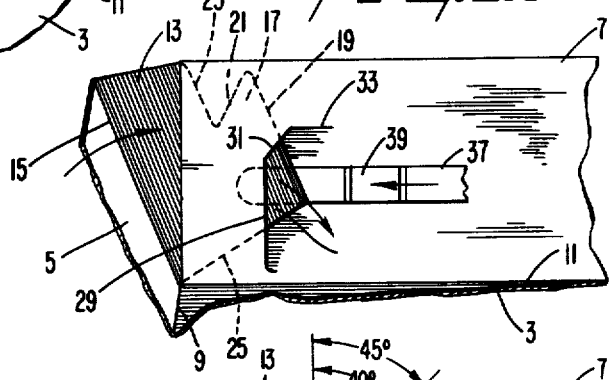
Fig. 3B
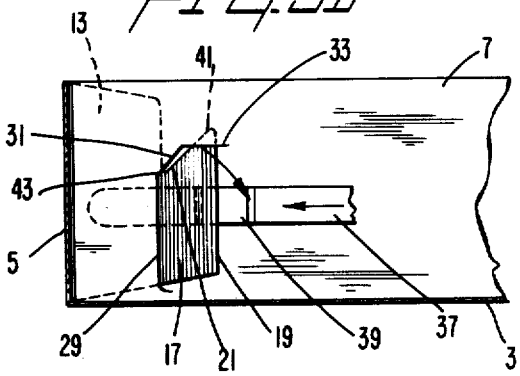
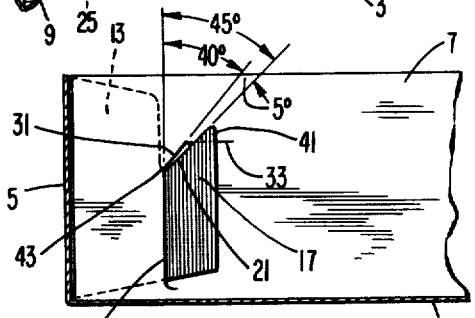
Fig. 3C

LOCK FOR A CORNER LOCK CARTON

BACKGROUND OF THE INVENTION

The invention relates to the field of locking devices for paperboard cartons and, more particularly, to a corner lock for a carton exhibiting improved lock retention.

Over the years it has been a goal of carton manufacturers to produce a corner lock for paperboard cartons which is simple to construct and erect using automatic machinery, and which provides a secure interlock between the carton side panels regardless of the forces applied to the lock.

Corner-lock type cartons are well known in the art and are usually folded and erected from a paperboard blank through the use of automatic machinery. Generally, the paperboard blank, which has already been cut and scored, is fed into the carton erecting machine and folded along the score lines to form the carton. In some types of open tray cartons, due to the resiliency of the paperboard, the side panels of the carton do not stand perpendicular to the base panel but appear bowed slightly outward after they are erected. Therefore, the carton folding and erecting procedure sometimes includes a step in which the erected side panels are "overbroken", i.e., folded inwardly beyond an angle perpendicular to the base panel after erection, in order to make the wall panel stand perpendicular to the base panel when pressure is released.

Some form of more secure lock retention means is thus required, especially for this type of corner lock carton. One type of retention means takes the form of an extended portion or tongue of the lock member which is pulled or pushed through the slit. This corner lock is known as a stripper lock. The locking tongue is "stripped" or forced through the slit by means of an arm provided on the carton erecting apparatus. Even as secure as prior art "stripper-type" locking arrangements have been, when the erected side panels are "overbroken" along their crease lines, the projecting portion of the tongue, which acts as the retention means for the lock, still may be accidentally released and slip through the slit, allowing the corner lock to become accidentally disengaged.

One type of corner lock for cartons is illustrated in U.S. Pat. Nos. 2,580,181 and 2,712,409. These patents show an angled locking tongue formed on a corner panel which interengages a complementary slit formed on the adjacent side panel. An edge of the locking tongue and the slit lie parallel to, and are in contact with, one another along their engaging edges so as to distribute forces along the entire length of the engaging edges.

Another type of corner lock is shown in U.S. Pat. Nos. 3,069,061 and 3,226,006 in which a locking tongue having an angled edge is formed on a corner panel and interengages an angled slit formed on a side panel. The angled edge of the tongue and the angled slit are disposed at an angle to each other such that their respective edges cross at a single point midway along their edges.

U.S. Pat. No. 3,037,680 also discloses a corner lock in which an angled edge of a locking tongue also interengages an angled slit formed on a side panel. The slit is disposed at an angle slightly different than the angle of the tongue edge. The edges cross at a point near the juncture of the locking tongue with its corner panel and approximately midway along the angled slit edge.

The above-described types of corner locking arrangements have the disadvantage that if the wall panels are put under stress, especially outwardly directed stress, the point of contact of the engaging edges of the corner lock tend to move, resulting in greater wear and possible failure of the lock while under stress. In addition, the locking tongue can become disengaged from the slit under inwardly directed side panel movement, allowing the corner lock to become disengaged.

Thus it is a primary object of the invention to provide an improved lock for a corner lock-type carton having positive and secure lock retention means.

It is an additional object to provide an improved corner-lock type carton which is readily folded and erected by automatic machinery.

It is another object to provide an improved "stripper-type" lock for a corner lock carton exhibiting reduced wear under stress.

It is a further object to provide an improved lock for a corner lock-type carton which is simple in construction and easily manufactured.

SUMMARY OF THE INVENTION

These and other objects are achieved by the present invention wherein there is provided an improved corner lock carton having a base panel, a pair of wall panels hingedly connected to the base panel, and a locking flap panel hingedly connected to one of the wall panels. The other wall panel includes a slit formed inwardly thereon to receive the locking flap panel. The slit has a vertical segment, a horizontal segment, and an angled segment connecting the vertical and horizontal segments; the ends of the angled segment being disposed at an angle no greater than 40° with respect to the vertical segment.

The flap panel includes a lock member having a first edge portion aligned parallel to the vertical segment of the slit when the carton is erected, and a second edge portion disposed at an angle of at least 45° to the first edge portion. When the wall panels are erected, the lock member is disposed through the slit and the second edge portion of the lock member engages the slit at a point adjacent the juncture of the vertical segment and the angled segment to securely interlock the flap panel and slit together.

The angled slit segment and the angled edge of the lock member have an angular separation of approximately 5° when interlocked. Since the point of interlocking engagement is adjacent the base of a "V" formed by the lock member and the vertical and angled segments, when either inwardly or outwardly directed pressure is applied to the carton side panels, as during an over-breaking operation or when the carton is filled with items, respectively, the point of interlocking engagement advantageously does not shift.

In an alternative embodiment of the invention, the angled segment is formed having an arcuate shape to provide a "double-locking" retention feature. When erected, the arcuate "bulge" overlies the angled edge of the lock member performing the secondary retention function.

In addition to enhanced lock retention, the carton of the present invention exhibits minimum wear. This results from the fact that the point of engagement of the lock member and the slit do not tend to shift under stress applied to either the lock or the wall panels. Point-to-point interlocking engagement, as used in the present invention, prevents the erected wall panels from shifting, as would occur with prior art corner locks having edge to edge interlocking engagement.

The angled edge of the lock member and the angled slit segment form a "V", the base of which defines the contact point between the lock member and slit segment. Unlike prior art corner locks wherein the lock member and slit cross at a point to form an "X", the corner lock of the present invention has a substantially constant angular separation of about 5° between the facing edges of the slit and lock member. The vertical edge of the wall panel having the slit abuts the first wall panel along the score of the lock panel when the carton is erected. Thus, regardless of the forces applied to the wall panels, slit, or lock member, the point of contact between the slit and lock member does not shift. The lock member of the present invention can only be unfastened by deliberately pulling or reverse stripping the upper portion of the lock member back through the slit.

In the "double-locking" embodiment of the invention, when the corner lock is assembled, the arcuate segment of the slit engages or overlies the angled portion of the locking member and also provides a more prominent engaging point or cusp (at the juncture of the arcuate slit segment with the vertical slit segment). The basic configuration of the locking member of this embodiment with its 45° locking edge is identical to that of the first embodiment described above. Furthermore, an imaginary line through the endpoints of the arcuate segment are disposed at an angle no greater than 40° to the vertical slit segment. Thus, the angled edge of the lock portion and the endpoints of the arcuate slit segment have the same included angle of at least 5° therebetween. Since engagement of the lock portion of the slit is normally at the lower cusp of the arcuate segment, once the lock portion and the slit are assembled, the point of contact therebetween cannot shift under normal conditions of stress. This results in increased stability in the relationship of the interlocked sidewall panels with respect to each other, and a low likelihood that the locking portion can shift or disengage when stress is placed on it, or on the sidewall panels.

Since the arcuate segment also defines an upper cusp where it joins the horizontal segment, if for some reason the secondary locking function is not obtained or is lost, such as by being caught on an article carried in the carton or through extreme stresses applied to the panel walls, the upper cusp still acts as a safety catch or "trap" to securely retain the upper portion of the lock.

Either embodiment of the corner lock carton of the present invention is readily formed from a paperboard blank and can be erected and assembled using conventional machinery. Advantageously, the locking member is interlocked with the slit during what is known in the art as a "stripping" operation, in which an arm attached to the automatic machinery pushes or pulls the locking member through the slit.

BRIEF DESCRIPTION OF THE DRAWING FIGURES

These and other features and advantages of the present invention will be apparent from the following detailed description of the preferred embodiments of the present invention taken in conjunction with the accompanying drawings wherein:

FIG. 1 is a partial plan view of one corner of a paperboard blank formed in accordance with a first embodiment of the invention;

FIG. 2 is a perspective view of an outside corner of the corner lock carton of FIG. 1, shown in its erected and locked position;

Figure 5:
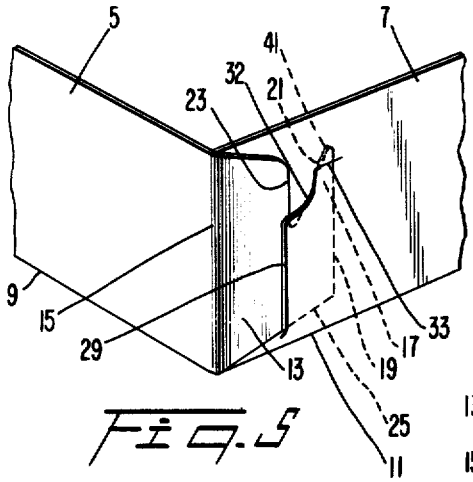
Figure 4:
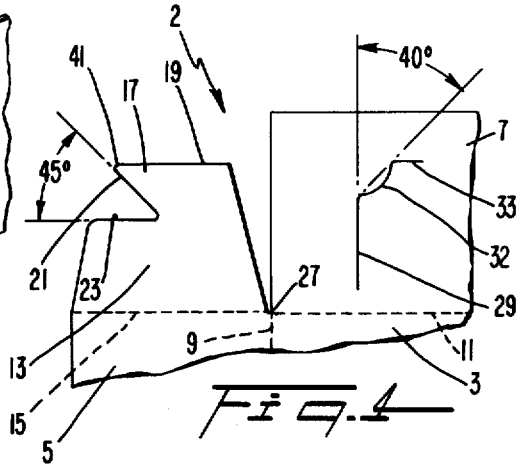

FIGS. 3A, 3B, and 3C are partial side views of the interior of the corner lock carton shown in FIG. 2, illustrating the steps taken in erecting and interlocking the corner lock carton;

FIG. 4 is a partial plan view of one corner of a paperboard blank formed in accordance with a second embodiment of the invention;

FIG. 5 is a perspective view of an outside corner of the corner lock carton of FIG. 4, shown in its erected and locked position;

FIGS. 6A, 6B, 6C, and 6D are partial side views of the interior of the corner lock carton shown in FIG. 5, illustrating the steps taken in erecting and interlocking this embodiment of the corner lock carton.

DETAILED DESCRIPTION OF THE PREFERRED EMBODIMENTS

Carton blank 1 includes a base panel 3, first and second wall panels 5 and 7, respectively, hingedly connected to base panel 3 by means of fold or score lines 9 and 11, respectively. Wall panel 5 includes a locking flap panel 13, hingedly connected to panel 5 by fold 15. Folds 9 and 11 are formed substantially perpendicular to one another. Fold 15 is also perpendicular to fold 9.

Flap panel 13 includes a lock member or tongue 17. Lock member 17 includes a first edge portion 19 which is substantially parallel to fold 15, and a second edge portion 21 disposed at an angle of 45° to edge portion 19 and fold 15. A third edge portion 23 formed substantially parallel to fold 15 joins angled edge 21 to the outer perimeter of flap panel 13. The included angle between edges 21 and 23 is approximately 45°. Flap panel 13 also includes an edge 25 disposed between edge 19 and carton corner 27. Edge 25 may be formed substantially perpendicular to edge 19 and fold 15, or at a slight clearance angle thereto, as illustrated in FIG. 1.

Wall panel 7 includes slit means, formed on an inward portion thereof, comprising vertical segment 29, angled segment 31, and horizontal segment 33. Slit segment 29 is disposed substantially perpendicular to fold 11. Segment 31 adjoins or intersects segment 29 and is disposed at an angle of 40° with respect thereto. The opposite end of angled segment 31 (as viewed in FIG. 1) adjoins or intersects segment 33.

Paperboard blank 1 is formed by means of conventional cutting and scoring machinery which is well-known in the art. Only one corner lock for blank 1 is shown in FIG. 1, it being understood that the actual carton would include four such corner locks (for a rectangular carton). Of course, the corner lock illustrated in FIG. 1 could be used for interlocking other shapes and sizes of cartons. The carton, in addition to being a tray when erected, may of course, form a top or cover for a tray.

FIG. 2 is a partial perspective view of the corner lock carton of FIG. 1 shown in its erected and assembled position. Wall panels 5 and 7 are erected substantially perpendicular to base panel 3, and lock member 17 is interlockingly engaged with the slit means. This is actually done on automatic carton erecting apparatus, such as shown in U.S. Pat. No. 3,400,877, owned by the assignee of the present invention. The actual steps of assembling carton 1 in interlocking lock member 17 with the slit are shown in FIGS. 3A–3C, as will become clear from the discussion below.

The corner lock of the present invention is of the type known in the art as a "stripper" lock, i.e., locking member 17 is partially inserted through the slit means and then "stripped" or pulled through the slit to complete the interlocking process. Generally, the "stripping" process is performed by means of a stripper arm, such as shown in U.S. Pat. No. 3,053,429. The stripper arm is usually part of the carton erecting or assembling apparatus.

As shown in FIGS. 3A–3C, during erection, wall panels 5 and 7 are folded upwardly, and simultaneously, flap panel 13 is progressively folded so as to eventually lie substantially parallel to, and in contact with, the outside face of panel 7. As the panels 5, 7 and 13 are thus folded into an erected position, stripper arm 37, which may include a raised section or area 39 formed thereon, is inserted (to the left in FIG. 3A) between the two cut edges of the slit means along vertical slit segment 29. A corner portion of the locking flap 13, comprising the intersection of edges 19 and 25, is initially inserted through the opening in the slit caused by the action of stripper arm 37.

When wall panel 5 is fully erected (i.e., substantially perpendicular to base panel 3), locking flap panel 13 is disposed in the position shown in FIG. 3B. All except an uppermost portion 41 of lock member 17 is disposed through the slit means to lie within the interior of the carton. Stripper arm 37 continues its leftward movement with raised area 39 contacting the lock member along edge 19. The leftward movement of stripper arm 37 causes the resilient upper portion of 41 of lock member 17 to be "stripped" so as to then lie completely within the interior of the carton, as shown in FIG. 3C.

Oftentimes, depending on the nature of the paperboard used, after the carton is erected, the wall panels are bowed slightly outward. Therefore, subsequent to the folding and stripping operation, the wall panels may be "over-broken" (i.e., folded beyond their nearly perpendicular position toward the interior of the carton). Because of the resiliency of the paperboard forming the carton, the wall panels spring back slightly after being overbroken so as to be disposed substantially perpendicular to the base panel, as desired.

In FIG. 3C, the corner lock is shown in its completely interlocked position. As can be seen, the angular separation or "V" between edge 21 of the lock member and angled slit segment 31 is apparoximately 5°. Upper portion 41 of the lock member overlaps horizontal segment 33 of the slit means.

The lower portion of lock member edge 21 and the lower end of angled segment 31 (where it joins vertical segment 29) contact each other at a single point 43. Point 43 is the base of the "V" formed by lock member edge 21 and angled slit segment 31. Unlike prior art corner locks in which engagement is along two facing edges or at a point midway along an angled segment, the present invention provides a secure interlock between the slit and lock member which does not tend to loosen or wear under stress. Since the point of contact 43 between angled slit segment 31 and lock member edge 21 is at the base of a "V" formed by these members, if wall panel 5 is stressed outwardly (e.g., by articles contained within the carton or by rough handling of the carton) the point of interlocking contact 43 advantageously remains the same. Since the point of interlocking contact 43 does not shift under normal stresses, the wear between the lock member and the slit means is minimal. This results in a long-lived corner lock for the carton.

In addition, since at least a 5° angular separation is provided between the edges of angled slit segment 31 and angled edge 21 of the lock member, even if side wall 5 is outwardly stressed, the two facing edges of the angled slit segment and the lock member will not come into contact. This feature, in combination with the overlapping of upper portion or catch 41 of lock member 17 with horizontal slit segment 33, provides a secure interlock for the corner lock carton, which can be unfastened only be deliberately reverse stripping the catch 41 back through the slit means.

FIG. 4 is a partial plan view of a second embodiment of the present invention wherein a "double-locking" feature is provided for a corner lock carton 2. The general arrangement of parts in FIG. 4 is similar to that of FIG. 1, with identical reference numerals indicating identical parts in the two embodiments. As is apparent from FIG. 4, an arcuate slit segment 32 connecting vertical slit segment 29 and horizontal slit segment 33 replaces the straight angled segment 31 shown in FIG. 1. A line drawn between the end points of arcuate slit segment 32 is disposed at an angle of 40° with respect to vertical slit segment 29. The convex side of segment or bulge 32 faces in the direction of the fold line 11 of wall panel 7.

FIG. 5 is a perspective view of the outside corner of the corner lock carton of FIG. 4 showing it in an erected position. The method of erecting the corner lock is shown in FIGS. 6A through 6D.

Figure 6A:
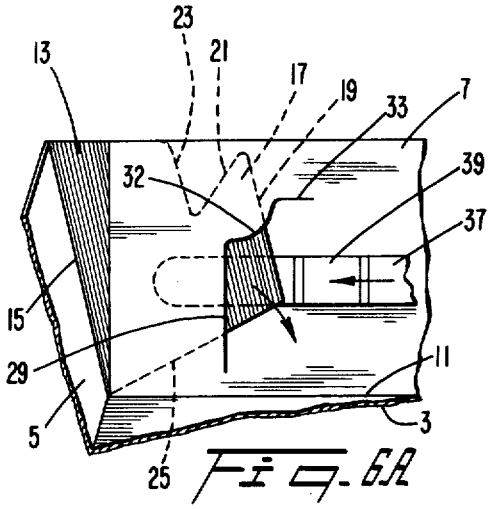

In FIG. 6A, wall panel 7 is shown in its erected position substantially perpendicular to base panel 3. Flap panel 13 is being folded with respect to wall panel 5 so as to eventually lie substantially parallel to, and in contact with, the outside face of panel 7. As wall panel 5 is folded about score 9 into an erected position, stripper arm 37 is inserted (to the left in FIG. 6A) between the two cut edges of the slit means which comprise vertical slit segment 29. A portion of locking flap 13, comprising edges 19 and 25, is then inserted through the opening in the slit caused by the action of the stripper arm 37.

Figure 6B:
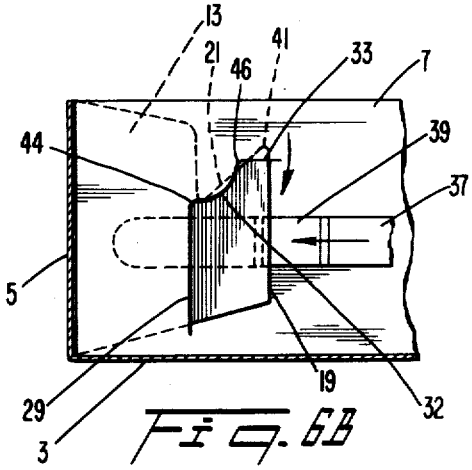
Figure 6C:
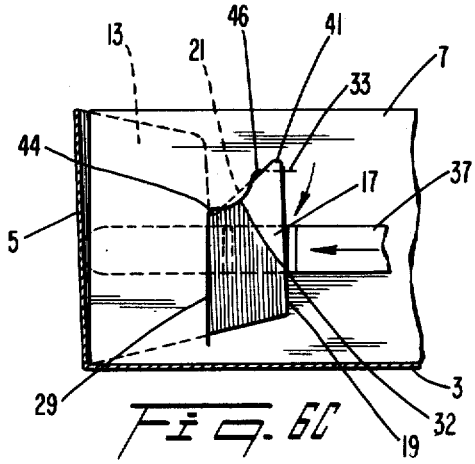

When wall panel 5 is fully erected (i.e., substantially perpendicular to base panel 3), locking flap panel 13 is disposed in the position shown in FIG. 6B. Stripper arm 37 continues its leftward movement with raised area 39 contacting the lock member along edge 19. This causes the resilient catch member 41 of lock member 17 to be pushed or "stripped" past horizontal segment 33 so as to lie partially within the interior of the carton, as shown in FIG. 3C.

At this stage, arcuate segment 32 still overlies a portion of edge 21 of lock member 17. As stripper arm 37 continues its leftward motion, this intermediate portion of lock member edge 21 is "stripped" so as to move inside and overlap the bulge or arcuate segment 32, as shown in FIG. 6D.

Figure 6D:
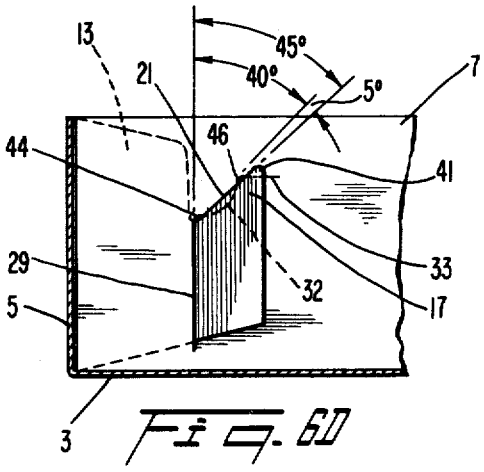

Thus, in FIG. 6D, the corner lock is shown in its complete or double locked position. The angular separation between edge 21 of the lock member and the line between the end points of the arcuate segment is advantageously approximately 5° for maximum locking security and resistance to wear. Upper portion or catch 41 of the lock member overlaps horizontal segment 33 of the slit means. The lower portion of lock member edge 21 and the lower end or cusp or arcuate segment 32 (where it joins vertical segment 29) contact each other at a single point 44. Point 44 is a more secure interlocking point between lock member 17 and the slit means because of the exaggerated cusp. The five degree separation between a line or chord drawn through the endpoints of the arcuate segment 32 and edge 21 of the lock member provides advantages similar to those described above with respect to the first embodiment of the invention, e.g., reduced wear at the point of interlocking engagement and reduced likelihood of the interlocking point shifting and disengaging when placed under stress.

It is clear that this second embodiment of the invention provides a positive "double-locking" or safety catch feature. Lock member 17 cannot be accidentally disengaged from the lower contact point 44 of the arcuate slit segment 32, such as when large forces are applied to wall panel 5 during an "over-breaking" operation, due to the overlap of the arcuate segment 32. This supplements the locking function of catch 41 of lock member edge 21 "trapped" or caught above point 46 adjacent to the upper cusp or juncture arcuate slit segment 32. The arcuate slit segment thus acts as a safety catch for the lock member. As a result, the corner lock can be disengaged only by deliberately forcing or stripping the lock member 17 back through the slit means past two separate retainers or catches. Thus, the second embodiment of the invention not only provides the desirable point-to-point interlocking contact of the first embodiment but also a "double-locking" retention feature.

While the corner lock carton of the present invention has been described in considerable detail, it is understood that various changes and modifications may occur to persons of ordinary skill in the art without departing from the spirit and scope of the invention as defined in the appended claims.

What is claimed is:

1. An improved corner lock carton formed from a paperboard blank or the like, comprising:

(a) a base panel;

(b) first and second wall panels formed adjacent to said base panel and separated therefrom respectively by first and second fold lines;

(c) a locking flap panel formed adjacent to said first wall panel and separated therefrom by a fold line, said flap panel fold line being substantially perpendicular to said first fold line;

(d) slit means formed on said second wall panel and spaced inwardly thereon, said slit means cooperating with said locking flap panel to form an interlocking corner for said carton, said slit means comprising:

(i) a first segment substantially perpendicular to said second fold line;

(ii) a second segment adjoining said first segment, at least the ends of which being disposed at a first acute angle with respect to said first slit segment; and (iii) a third segment adjoining said second segment, said third segment being substantially parallel to said second fold line;

(e) said locking flap panel including a lock member, said member having a first edge portion substantially parallel to said flap panel fold line and a second edge portion disposed at a second acute angle with respect to said flap panel fold line, said second acute angle being greater than said first acute angle, said first and second edge portions defining said lock member; whereby when said wall panels are erected, a portion of said flap panel which includes said lock member is disposed through said slit means with said second edge portion of said lock member engaging said second segment of said slit means at a point substantially adjacent the juncture of said second slit segment with said first slit segment, and defining an acute included angle therebetween with an upper portion of said lock member overlapping said third slit segment, to securely interlock and retain said lock member and said second wall panel together.

2. The corner lock carton of claim 1 wherein said second slit segment is substantially straight.

3. The corner lock carton of claim 1 wherein said second slit segment is arcuately shaped.

4. The corner lock carton of claim 3 wherein said arcuately shaped second slit segment has its convex side directed toward the fold line of the second wall panel.

5. The corner lock carton of any one of claims 1–4 wherein said first acute angle is no greater than 40°, said second acute angle being at least 45°, and said acute included angle is approximately 5°.

6. An improved corner lock carton formed from a paperboard blank, comprising:

(a) a base panel;

(b) first and second wall panels formed adjacent said base panel and separated therefrom respectively by first and second fold lines;

(c) a locking flap panel formed adjacent said first wall panel and separated therefrom by a fold line, said flap panel fold line being substantially perpendicular to said first fold line;

(d) slit means formed on said second wall panel and spaced inwardly thereon, said slit means cooperating with said locking flap panel to form an interlocking corner for said carton, said slit means comprising:

(i) a first segment substantially perpendicular to said second fold line;

(ii) a second segment adjoining said first segment, said second segment disposed at an angle no greater than 40° with respect to said first slit segment; and (iii) a third segment adjoining said second segment, said third segment substantially parallel to said second fold line;

(e) said locking flap panel including a lock member, said member having a first edge portion substantially parallel to said flap panel fold line and a second edge portion disposed at an angle of at least 45° to said flap panel fold line, said first and second edge portions defining the perimeter of said lock member; whereby when said wall panels are erected, a portion of said flap panel which includes said lock member is disposed through said slit means, with said second edge portion of said lock member engaging said second segment of said slit means at a point substantially adjacent the juncture of said second slit segment with said first slit segment and defining an angle of approximately 5° therebetween, with an upper portion of said lock member overlapping said third slit segment, to securely interlock said lock member and said second wall panel together.

7. An improved double locking carton formed from a paperboard blank or the like, comprising:

(a) a base panel;

(b) first and second wall panels formed adjacent to said base panel and separated therefrom respectively by first and second fold lines;

(c) a locking flap panel formed adjacent to said first wall panel and separated therefrom by a fold line, said flap panel fold line being substantially perpendicular to said first fold line;

(d) slit means formed on said second wall panel and spaced inwardly thereon, said slit means cooperating with said locking flap panel to form an interlocking corner for said carton, said slit means comprising:

(i) a first segment substantially perpendicular to said second fold line;

(ii) a second segment having an arcuate shape and adjoining said first segment, at least the ends of which being disposed at an angle no greater than 40° with respect to said first slit segment; and (iii) a third segment adjoining said second segment, said third segment substantially parallel to said second fold line;

(e) said locking flap panel including a lock member, said member having a first edge portion substantially parallel to said flap panel fold line and a second edge portion disposed at an angle of at least 45° with respect to said flap panel fold line, said first and second edge portions defining said lock member; whereby when said wall panels are erected a portion of said flap panel which includes said lock member is disposed through said slit means, with said lock member engaging said second segment of said slit means at a point substantially adjacent to the juncture of said second slit segment with said first segment, and with an upper portion of said lock member overlapping a portion of said arcuate slit segment and said third slit segment, to securely interlock said lock member and said second wall panel together, said arcuate segment acting as a secondary catch to prevent accidental disengagement of said locking member and said slit means.

8. The corner lock carton of claim 7 wherein said arcuately shaped second slit segment has its convex side directed toward the fold line of the second wall panel.

* * * * *